US010710088B2

(12) United States Patent
Salonen

(10) Patent No.: US 10,710,088 B2
(45) Date of Patent: Jul. 14, 2020

(54) SYSTEM AND METHOD FOR MONITORING AND CONTROLLING A CRUSHER, A CRUSHER AND A METHOD FOR ADJUSTING A CRUSHER

(71) Applicant: Metso Minerals, Inc., Helsinki (FI)

(72) Inventor: Marko Salonen, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 1127 days.

(21) Appl. No.: 14/391,190

(22) PCT Filed: Apr. 11, 2013

(86) PCT No.: PCT/FI2013/050397
§ 371 (c)(1),
(2) Date: Oct. 8, 2014

(87) PCT Pub. No.: WO2013/153283
PCT Pub. Date: Oct. 17, 2013

(65) Prior Publication Data

US 2015/0076259 A1 Mar. 19, 2015

(30) Foreign Application Priority Data

Apr. 12, 2012 (FI) ..... 20125398

(51) Int. Cl.
*B02C 25/00* (2006.01)
*B02C 2/04* (2006.01)

(52) U.S. Cl.
CPC ..... *B02C 2/047* (2013.01); *B02C 25/00* (2013.01)

(58) Field of Classification Search
CPC ..... B02C 2/047; B02C 25/00
(Continued)

(56) References Cited

U.S. PATENT DOCUMENTS 4,467,971 A 8/1984 Schuman
4,566,638 A 1/1986 Lundin et al.
(Continued)

FOREIGN PATENT DOCUMENTS

WO 87/05828 A1 10/1987
WO 02/36264 A1 5/2002
(Continued)

OTHER PUBLICATIONS

International Search Report dated Sep. 25, 2013.
(Continued)

*Primary Examiner* — Shelley M Self
*Assistant Examiner* — Smith Oberto Bapthelus
(74) *Attorney, Agent, or Firm* — Andrus Intellectual Property Law, LLP

(57) ABSTRACT

A gyratory or cone crusher includes a measuring apparatus suitable for measuring load of the crusher, a first element placed on a main shaft of the crusher and a first detector suitable for detecting the first element which first detector provides a trigger starting a measurement revolution, and at least one second element placed on a drive shaft of the crusher and a second detector suitable for detecting the second element and providing a trigger corresponding to a certain rotational position of an inner blade of the crusher. The system includes an output to a screen for presenting the loads or averages of the loads corresponding to rotational positions of the inner blade of the crusher. Detections of the monitoring system can be used for controlling and monitoring a crushing event, such as by changing an area or a location of a feed opening of the crusher.

26 Claims, 4 Drawing Sheets

(58) Field of Classification Search
USPC ..... 241/30
See application file for complete search history.

(56) References Cited

U.S. PATENT DOCUMENTS 4,793,560 A * 12/1988 Schrodl ..... B02C 2/047 241/207
7,173,411 B1 * 2/2007 Pond ..... H03K 17/9502 324/207.12
7,845,237 B2 * 12/2010 Torres ..... B02C 2/047 73/760
7,850,103 B2 * 12/2010 Eriksson ..... B02C 2/047 241/207
8,172,167 B2 * 5/2012 Hedin ..... B02C 25/00 241/207
8,496,195 B2 * 7/2013 Sjoberg ..... B02C 23/04 241/207
9,149,812 B2 * 10/2015 Belotserkovskiy ..... B02C 2/042
9,283,568 B2 * 3/2016 Belotserkovskiy ..... B02C 2/042
2009/0008486 A1 * 1/2009 Torres ..... B02C 2/047 241/33
2009/0256015 A1 * 10/2009 Torres ..... B02C 2/047 241/30
2009/0259434 A1 * 10/2009 Loyer ..... B02C 2/06 702/159
2009/0294560 A1 12/2009 Yamaguchi et al.

FOREIGN PATENT DOCUMENTS

WO 2008153454 A1 12/2008
WO 2009/008796 A1 1/2009
WO 2009/145702 A1 12/2009
WO 2012/098292 A1 7/2012

OTHER PUBLICATIONS

Finnish Search Report dated Feb. 11, 2013.
Office Action for corresponding Indian Patent Application No. 2002/KOLNP/2014 dated Mar. 25, 2019.

* cited by examiner

SYSTEM AND METHOD FOR MONITORING AND CONTROLLING A CRUSHER, A CRUSHER AND A METHOD FOR ADJUSTING A CRUSHER

CROSS-REFERENCE TO RELATED APPLICATIONS

This application claims priority to PCT/FI2013/050397, filed Apr. 11, 2013, and published in English on Oct. 17, 2013 as publication number WO 2013/153283, which claims priority to FI Application No. 20125398, filed Apr. 12, 2012, incorporated herein by reference.

TECHNICAL FIELD

The invention relates to an apparatus and a method for monitoring and controlling a crusher, a crusher and a method for adjusting a crusher. The invention relates particularly, though not exclusively, to protecting a gyratory or cone crusher from uncrushable material.

BACKGROUND ART

Rock is gained from the earth for crushing by exploding or excavating. Rock can also be natural and gravel or construction waste. Mobile crushers and stationary crushing applications are used in crushing. An excavator or wheeled loader loads the material to be crushed into the crusher's feed hopper from where the material to be crushed may fall into the crusher or a feeder moves the rock material towards the crusher.

Mineral material is crushed in gyratory and cone crushers by moving an inner blade (crushing cone) relative to an outer blade. The inner and outer blades define therebetween a crushing chamber. Commonly gyratory and cone crushers are adjusted for different types of production requirements by changing profile of the crushing chamber, amount of eccentric motion of the crushing cone or stroke, rotational speed of the crushing cone and setting of the crusher.

Crushing capacity of a gyratory and cone crusher is aimed to be used economically fully so that the crusher is loaded continuously with a high crushing power and simultaneously the used crushing power is directed for producing the planned product distribution. Interruptions in the crushing event (e.g. caused by overload) reduce efficiency.

Ending up of uncrushable or very hard material in a crushing chamber is disadvantageous. In such a case, an overload situation may arise in the crushing chamber and the crushing blade(s) may be damaged. In order to overcome the problem, the setting of the crusher has to be opened and the movable crushing blade has to be moved farther away from the fixed crushing blade. A concrete reinforcing bar is an example of adverse material which may end up in the crushing chamber when separating of material before the crushing is incomplete. Adverse is also material having unequal distribution and containing large pieces. Furthermore, the amount and location of the material in the crushing chamber affects the power intake of the crusher.

WO2009008796A1 shows a measuring apparatus for indicating the load in a gyratory crusher.

It is an object of the invention to provide an alternative way for indicating the load of a gyratory or cone crusher during crushing. It is an object of the invention to provide a simple way for indicating the load present in a crushing chamber. It is an object of the invention to improve adjusting chances of the crushing event. It is an object of the invention to improve usability and efficiency of the crusher.

SUMMARY

According to a first aspect of the invention there is provided a method for monitoring a gyratory or cone crusher, comprising:

- rotating a main shaft of the crusher and an inner blade arranged on the main shaft for creating repeating measuring revolutions;
- determining a starting point of a measuring revolution by a triggering from the main shaft of the crusher;
- determining at least one rotational position of the inner blade of the crusher by a triggering from a drive shaft of the crusher; and
- measuring a load of the crusher at the moment of every triggering from the drive shaft.

Preferably the load of the crusher is determined by a pressure measurement.

Preferably the load of the crusher is determined by a power measurement.

Preferably an average of the load of the crusher corresponding to every determined rotational position of the inner blade of the crusher is determined from a period of several measuring revolutions.

Preferably the triggering from the main shaft of the crusher is implemented by a magnetic detector or switch. The triggering from the main shaft of the crusher may be implemented by a detector or switch which may be inductive, capacitive, optical, based on ultrasound or based on electromagnetic radiation.

Preferably the triggering from the drive shaft of the crusher is implemented by a magnetic detector or switch. The triggering from the drive shaft of the crusher may be implemented by a detector or switch which may be inductive, capacitive, optical, based on ultrasound or based on electromagnetic radiation.

Preferably the load of the crusher corresponding to each rotational position of the inner blade is presented on a screen to be observed by an operator.

According to a second aspect of the invention there is provided a system for monitoring a crusher, comprising:

- a measuring apparatus suitable for measuring load of the crusher;
- an element to be placed on a main shaft of the crusher and a detector suitable for detecting the element which detector is configured to provide a triggering starting a measurement revolution; and
- at least one element to be placed on a drive shaft of the crusher and a detector suitable for detecting the element which detector is configured to provide a triggering corresponding to a certain rotational position of an inner blade of the crusher.

Preferably the system comprises an output to a screen for presenting

- a load measured at the moment of the triggering corresponding to each rotational position of the inner blade of the crusher, or
- an average of a load, calculated from a period of several measuring revolutions, corresponding to said rotational positions of the inner blade of the crusher, and
- said rotational positions.

Preferably the system comprises a screen on which is presented an average of the load calculated from a period of several measuring revolutions, corresponding to the rotational positions of the inner blade of the crusher, and the rotational positions.

Preferably the said rotational positions of the inner blade of the crusher and the loads corresponding to said rotational positions or the averages of the loads are presented on a polar coordinate system.

Preferably the rotational position of the inner blade of the crusher is presented as a rotation angle.

Preferably the measuring apparatus suitable for measuring the load is measuring pressure.

Preferably the measuring apparatus suitable for measuring the load is measuring power.

Preferably the detector suitable for detecting the element to be placed on the main shaft is a magnetic detector. The detector may be inductive, capacitive, optical, based on ultrasound or based on electromagnetic radiation.

Preferably the detector suitable for detecting the elements to be placed on the drive shaft is a magnetic detector. The detector may be inductive, capacitive, optical, based on ultrasound or based on electromagnetic radiation.

According to a third aspect of the invention there is provided a method for monitoring a gyratory or cone crusher, which gyratory or cone crusher comprises a crushing chamber and a feed opening of the crushing chamber and an adjusting apparatus, wherein one or more movable adjusting parts comprised by the adjusting apparatus are arranged in connection with the feed opening and in which method a flow area of material to be crushed and flowing through the feed opening to the crushing chamber is adjusted during crushing by moving adjusting parts such that the flow area is decreased as a response to detecting an increase of an average load by a method or system according to an aspect of this invention, and the flow area is increased as a response to detecting a decrease of the average load by a method or system according to an aspect of this invention.

Preferably the feed of the material is adjusted during crushing in the method so that the amount of the material is increased at a rotational position of the inner blade which corresponds to a low load and is detected by a method or system according to an aspect of this invention.

According to a fourth aspect of the invention there is provided a system for monitoring and controlling a gyratory or cone crusher, which gyratory or cone crusher comprises a crushing chamber and a feed opening of the crushing chamber, a load monitoring system according to an aspect of this invention, and an adjusting apparatus, wherein one or more movable adjusting parts comprised by the adjusting apparatus are arranged in connection with the feed opening and which adjusting apparatus is configured to adjust during crushing a flow area of material to be crushed and flowing through the feed opening to the crushing chamber by moving adjustment parts such that the flow area is decreased as a response to an average load detected by a method or a system according to an aspect of this invention increasing, and the flow area is increased as a response to the average load detected by a method or a system according to an aspect of this invention decreasing.

Preferably the adjusting apparatus is configured to adjust feed of the material during crushing so that amount of the material is increased at a rotational position of the inner blade which corresponds to a low load and is detected by a method or system according to an aspect of this invention.

According to a fifth aspect of the invention there is provided a pressing crusher suitable for mineral material crushing such as a gyratory or cone crusher which comprises a crushing chamber and a feed opening of the crushing chamber, and the crusher comprises a system for monitoring the crusher according to an aspect of this invention, and an adjusting apparatus according to an aspect of this invention comprising one or more movable adjusting parts to be arranged in connection with the feed opening which one or more movable adjusting parts are movable during crushing to adjust a flow area of material to be crushed and flowing through the feed opening to the crushing chamber, and the one or more adjusting parts are configured to move so that the flow area is decreased as a response to the load detected by the system increasing, and the flow area is increased as a response to the load detected by the system decreasing.

Preferably the adjusting apparatus is configured to adjust the feed of the material during crushing so that amount of the material is increased at a rotational position of the inner blade which corresponds to a low load and is detected by a method or system according to an aspect of this invention.

Preferably the crusher comprises a crusher drive and a feedback control system which comprises a monitoring system and moving means of the adjustment parts for adjusting the adjustment parts based on detections of the monitoring system.

Preferably the crusher is a gyratory or cone crusher.

According to a sixth aspect of the invention there is provided a crushing plant which comprises a crusher according to an embodiment of this invention.

According to a seventh aspect of the invention there is provided a method for adjusting a pressing crusher which is suitable for mineral material crushing such as a gyratory or cone crusher, or a crushing plant, which gyratory or cone crusher or crushing plant comprises a crushing chamber and a feed opening of the crushing chamber, and an adjusting apparatus comprising one or more movable adjusting parts which are arranged in connection with the feed opening, and which gyratory or cone crusher or crushing plant comprises a system for monitoring the crusher according to an aspect of this invention, and in which method a flow area of material to be crushed and flowing through the feed opening to the crushing chamber is adjusted by moving the adjusting parts so that the flow area is decreased as a response to the load detected by the monitoring system increasing, and the flow area is increased as a response to the load detected by the monitoring system decreasing.

Preferably the gyratory or cone crusher comprises a crusher drive and a feedback control system which comprises a monitoring system according to an aspect of this invention and moving means of the adjustment parts so that in the method the load of the gyratory or cone crusher is monitored by the monitoring system according to an aspect of this invention, and the adjustment parts are moved based on detected load.

Preferably feed of the material is adjusted during crushing such that amount of the material is increased at a rotational position of the inner blade which is corresponding to a low load and is detected by a method or system according to an aspect of this invention.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will be described, by way of example, with reference to the accompanying drawings, in which.

DETAILED DESCRIPTION

In the following description, like numbers denote like elements. It should be appreciated that the illustrated drawings are not entirely in scale, and that the drawings mainly serve the purpose of illustrating embodiments of the invention.

Figure 1:
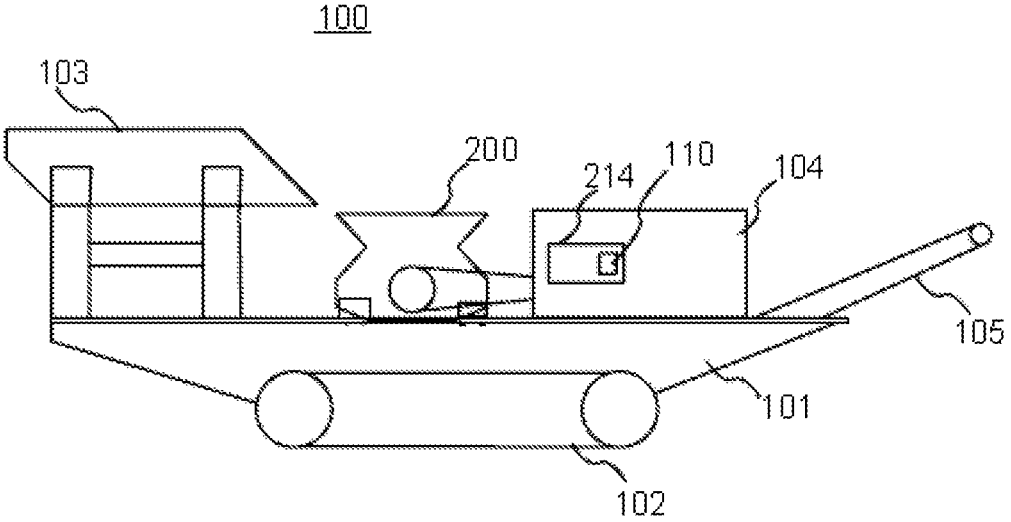
FIG. 1 shows a crushing plant comprising a crusher having a crushing chamber which is adjustable during crushing.

FIG. 1 shows a track-mounted mobile crushing plant 100 which comprises a body 101, a track base 102, a feeder 103 and a crusher 200 such as a cone or gyratory crusher. The crushing plant 100 further comprises a motor unit 104 for driving the crusher 200 and a conveyor 105 for conveying crushed material for example to a pile. The crusher can be used for example as an intermediate or after crusher. Particularly, the crusher can be used in fine crushing. The mobile crushing plant may be movable also by other means such as by wheels, runners or legs. The crushing station may also be stationary.

Preferably the crushing station comprises a feed hopper above a feed opening 730 (FIG. 7) of a crushing chamber of the crusher 200 (not shown in the Figures). While the crushing process is running the material to be crushed is fed (for instance by a loader) to a feeder 103, from where it is further fed to the crusher 200. The feeder 103 may also be a so called scalper or a conveyor may be connected in connection with the feeder (not shown in the Figures). The material to be crushed arriving from the feeder/conveyor is guided by the feed hopper into the feed opening 730 of the crushing chamber. The material to be crushed may be fed also directly to the feed hopper, for example by a loader.

The crushing station 100 further comprises a monitoring system 214.

Figure 7:
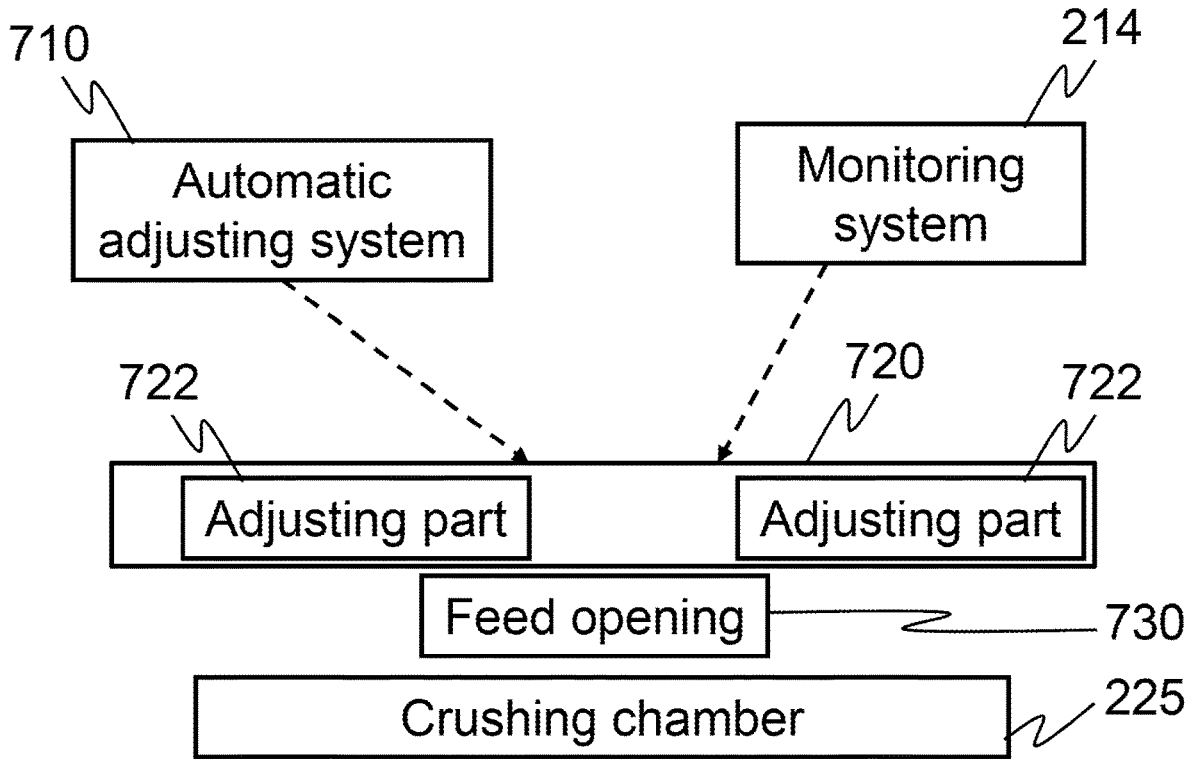
FIG. 7 shows a block diagram illustrating various embodiments relating to adjusting of feed opening of the crusher.

Preferably the crushing station comprises also an adjusting apparatus 720 of the feed opening 730 of the crusher as shown in FIG. 7. The adjusting apparatus 720 is located above the feed opening 730 so that flow of the material to be crushed to the underlying crushing chamber 225 can be adjusted. The adjusting apparatus 720 comprises an adjustable feed opening 730 which is implemented by arranging movable adjusting parts 722 in connection with the feed opening 730. The flow opening can be increased or decreased or its center point can be moved. The adjusting apparatus 720 may be operated manually by an operator or it may be connected to an automatic adjusting system 710. The adjusting apparatus 720 may be connected to the monitoring system 214, wherethrough the crusher can be adjusted based on a load detected by the monitoring system 214. For instance, a flow area of the feed opening 730 is decreased when the load detected by the monitoring system is increasing and the flow area of the feed opening 730 is increased when the load detected by the monitoring system 214 is decreasing. The location of the feed opening 730 can also be changed during crushing so that the feed opening 730 is moved in a direction corresponding to a rotational location of a main shaft 203 corresponding to a low load detected by the monitoring system. According to an embodiment, a conveyor feeding material to the crusher (not shown in the Figures) may be moved such that the material dropping into the crusher from the conveyor is guided into the crushing chamber 225 in the direction corresponding to a rotational location of the main shaft 203 corresponding to a low load detected by the monitoring system. Alternatively, feeding the material to the direction corresponding to a rotational location of the main shaft 203 corresponding to a low load detected by the monitoring system may be arranged by another known method by which feeding of the material into the crushing chamber 225 is increased such that the amount of the material is increased in a detected rotational location of the inner blade corresponding to a low load.

Figure 3:
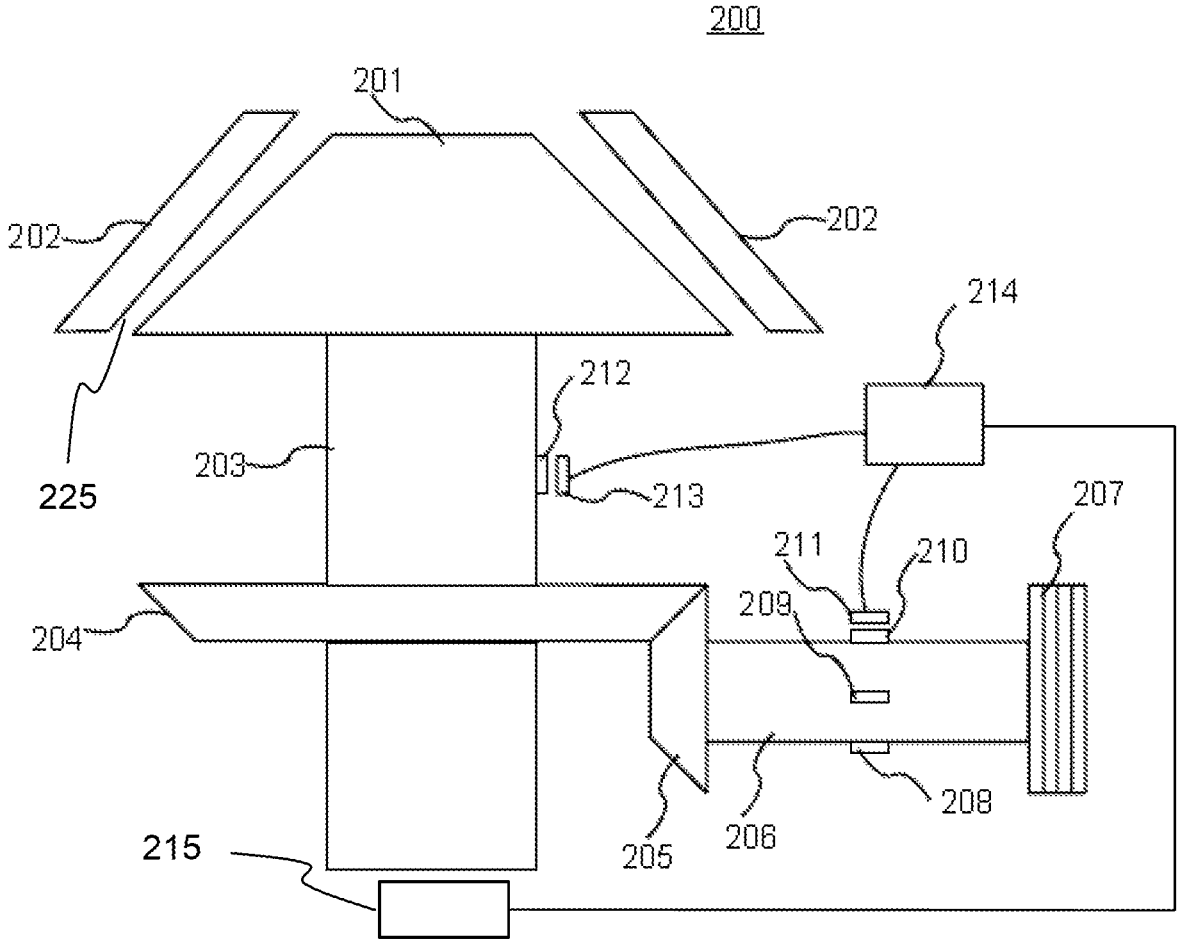
FIG. 3 shows a side view of a crusher according to a preferable embodiment of the invention and a monitoring system comprised by the crusher.

FIG. 3 shows a partial side section of the crusher 200. The crushing chamber of the crusher is located between a stationary outer wear part, an outer blade, 202, and a rotating inner wear part, an inner blade, 201. The main shaft 203 is rotating the inner blade 201 and a drive shaft 206 is rotating the main shaft 203 via a gear 204, 205. A rotational location of the main shaft 203 corresponds to the rotational location of the inner blade 201. The drive shaft 206 is rotated by a motor in the motor unit 104 for example through belt transmission via a belt wheel 207.

A measuring apparatus is located on the main shaft and consists of a first element 212 to be fixedly placed on the shaft and a first detector 213. The first detector 213 is connected to the monitoring system 214. A measuring apparatus is located on the drive shaft and consists of at least one second element 208,209, 210 fixedly placed on the shaft and a second detector 211. The second detector 211 is connected to the monitoring system.

The first and second detectors 211,213 may be like or different. The detectors may be inductive switches which detect proximity of the elements 208,209,210,212 made of suitable material and placed on the shaft.

The detectors 211,213 may be capacitive switches which detect proximity of the elements 208,209,210,212 made of suitable material and placed on the shaft.

The detectors 211,213 may be optical switches which detect proximity of the reflective elements 208,209,210,212 placed for example on the shaft.

The detectors 211,213 may be switches based on ultrasound which detect proximity of the elements 208,209,210, 212 placed for example on the shaft and reflecting ultrasound.

The detectors 211,213 may be switches based on electromagnetic radiation which detect proximity of the elements 208,209,210,212 placed for example on the shaft and reflecting electromagnetic radiation.

The load of the crusher is measured by a measuring apparatus 215 which measures the power of the crusher or the pressure of the crushing chamber 225 or both. The measuring apparatus measuring the load is implemented by conventional methods. For example, the pressure of the crushing chamber 225 can be measured from the hydraulic fluid loading the main shaft 203 from below. The power measurement of the crusher can be arranged for example from the current of an electric motor comprised preferably by the motor unit 104. The measuring apparatus 215 is connected to the monitoring system 214.

Figure 4:
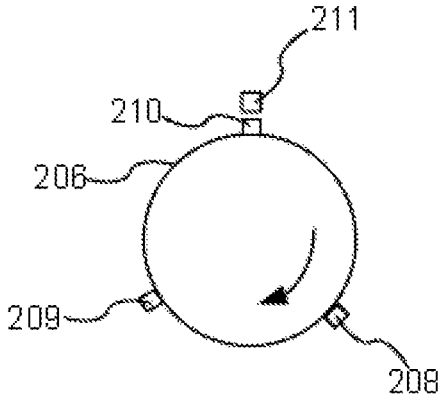
FIG. 4 shows the drive shaft of the crusher of FIG. 3 and parts of the monitoring system attached to the drive shaft.

FIG. 4 shows a partial section of the drive shaft 206. The at least one of the second elements 208,209,210 which are detected by the second detector 211 are located on the drive shaft. It is noted that three elements 208,209,210 are presented in the Figure for the purpose of illustration and the number of elements is not limited to three. Each of the at least one of the second elements 208,209,210 arrives in turn at the position of the second detector 211 when the drive shaft 206 is rotating. The detector gives a pulse to the monitoring system 214 when the at least one of the second element 208,209,210 is at the position of the detector.

Here, the pulse means any common signal which is transmitted from the detector or corresponding measuring apparatus or switch to the monitoring system 214 or the like. The second detector 211 may transmit for example a voltage of −5V to the monitoring system 214 when the at least one of the second element 208,209,210 is not at the position of the second detector 211 and a voltage of +5V when the at least one of the second element 208,209,210 is at the position of the detector. The signal may be for example a conventional standard message or the like, that enables a simple design of the monitoring system and compatibility with conventional automation systems or the like.

At least one of the second elements 208,209,210 are located fixedly on the drive shaft in predefined locations. Fixedly means in this context that the location of the at least one of the second elements 208,209,210 may be changed as needed but the locations are not changed while the apparatus is in operation. The fixed mounting of the at least one of the second elements 208,209,210 enables that the predefined locations of the elements, i.e. the rotational locations of the drive shaft corresponding to the locations of the elements, are saved in advance in the monitoring system 214, wherethrough a separate computing for determining the rotational position is not necessary while the apparatus is in operation. The first elements 212 located on the main shaft 203 are located fixedly in a corresponding manner.

A transmission of the main shaft 203 and the drive shaft 206 of the crusher is implemented for example so that substantially four revolutions of the drive shaft 206 correspond to a full revolution of the main shaft 203. Thus, during one measuring revolution, i.e. one full revolution of the main shaft 203, each of the at least one of the second element 208,209,210 located on the drive shaft is detected substantially four times by the second detector 211. In an example case in which three elements 208,209,210 are located on the drive shaft, during the measuring revolution twelve triggerings corresponding to the rotational position of the inner blade are received from the second detector 211, i.e. the load of the crusher 200 can be determined in twelve directions. The transmission of the main shaft 203 and the drive shaft is not precisely an integer so that the triggers during successive measuring revolutions do not exactly correspond to the same rotational positions of the inner blade.

Figure 5:
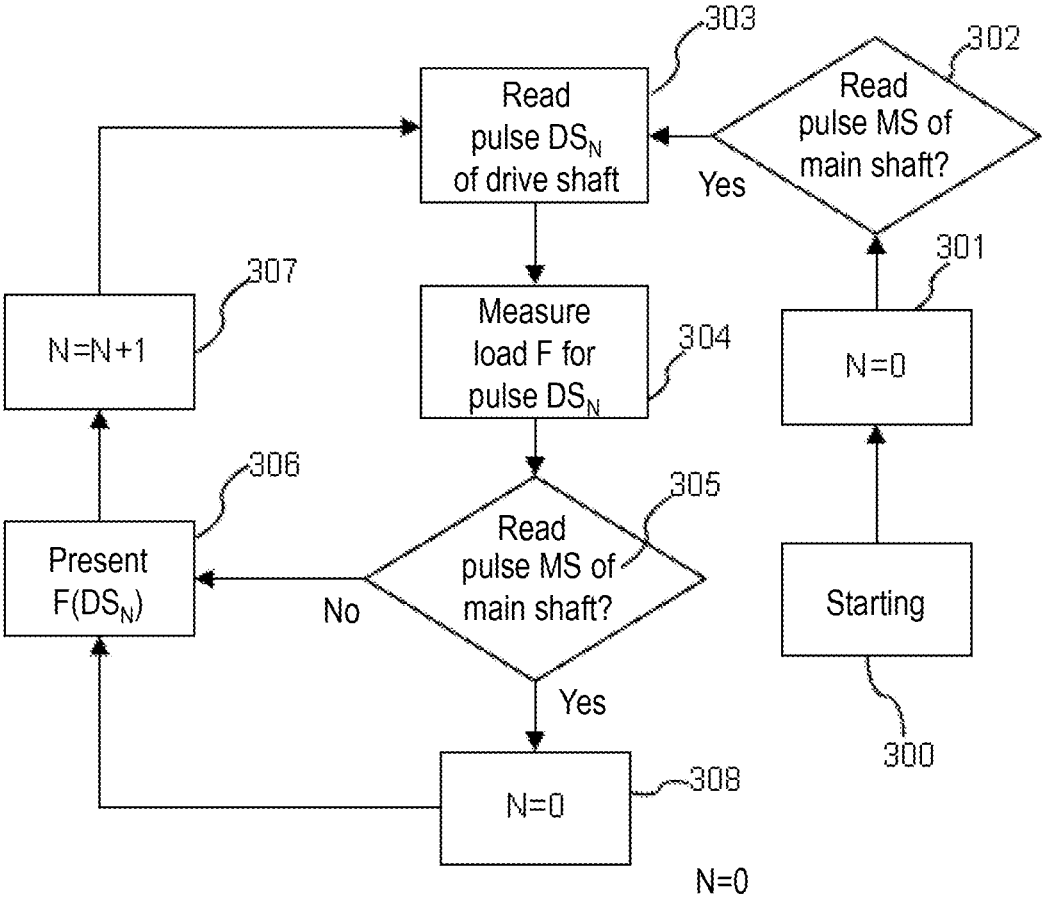
FIG. 5 shows a flow chart of a method according to a preferable embodiment.

FIG. 5 shows the functioning of the monitoring system 214 of the crusher with a flow chart of the monitoring method. As the system is starting an index N depicting the rotational location of the drive shaft 206 of the crusher is set to zero 301, after which the system waits that the rotational location of the main shaft 203 of the crusher changes as the main shaft rotates so that the first element 212 arrives at the location of the first detector 213, at which time the first detector 213 gives a pulse MS 302 of the main shaft to the monitoring system. When the pulse MS of the main shaft is read, the monitoring system waits for the at least one of the second element 208,209,210 to arrive at the location of the second detector 211 as the drive shaft 206 rotates, at which time the second detector 211 gives the pulse $DS_N$ 303 of the drive shaft to the monitoring system. Next, the monitoring system 214 reads the predefined rotational position of the drive shaft 206, and the load F, 304 corresponding to the pulse $DS_N$ corresponding to the rotational position, from the measuring apparatus 215 which is measuring the load. If a pulse MS is not readable at this phase from the first detector 213 of the main shaft 203, which means that the main shaft 203 has not yet rotated a full revolution after a previous pulse MS, the rotational position of the main shaft 203 and the corresponding load of the crusher is presented to an operator on screen 306 and the index N depicting the rotational location of the main shaft 203 is increased by one 307. If the transmission of the main shaft 203 and the drive shaft 206 is not precisely an integer, the pulses $DS_N$ of the main shaft during successive measuring revolutions do not correspond exactly to the same rotational positions of the main shaft 203 or the inner blade. In such a case, a certain sector corresponds to each index N depicting the rotational position of the main shaft, on which sector the pulse $DS_N$ of the main shaft depicting the rotational position of the inner blade lands regardless of the measuring revolution. The width of the sector in degrees is derived by dividing 360 degrees with the amount of the triggerings during a measuring revolution.

The screen on which the rotational location of the main shaft 203 and the corresponding load of the crusher is presented may be located as part of the monitoring system 214 or be part of an automation system of the entire crusher or crushing plant or the like. The monitoring system 214 may comprise an output for the screen for presenting the detections.

As the index depicting the rotational location of the main shaft 203 is increased by one, steps 303, 304, 305, 306 and 307 of the method are repeated until the pulse MS of the main shaft is readable in step 305, at which time the index N depicting the rotational location of the drive shaft 206 is set to zero 308, after which the steps 303, 304, 305, 306 and 307 of the method are repeated again.

In the monitoring method it is not necessary to measure time or rotational speed of the shafts of the crusher because the elements 208,209,210,212 of both the main shaft 203 and the drive shaft 206 of the crusher which are detected by the detectors 211,213 are fixedly mounted to predefined locations. In the monitoring method, the load of the crusher is determined in the rotational positions of the inner blade 201 of the crusher. The rotational position, or certain rotational positions, are found out from the pulses given by elements 208,209,210,212 fixedly mounted on the main shaft 203 and the drive shaft 206, and the detectors 211,213 used for detecting the elements. The monitoring method does not require complex computation or particular computing arrangements that for example a determination of the rotational position by measuring time and rotational speed would require.

Figure 2:
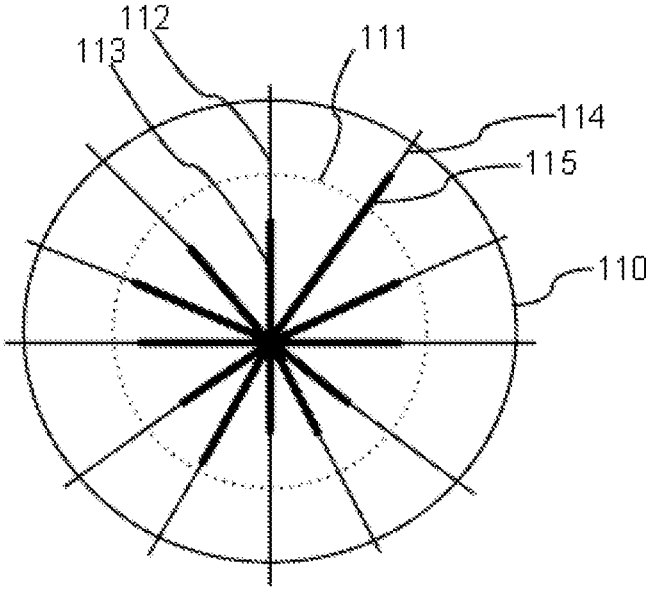
FIG. 2 shows a presentation of detections made by a monitoring system or method according to a preferable embodiment of the invention.
Figure 6:
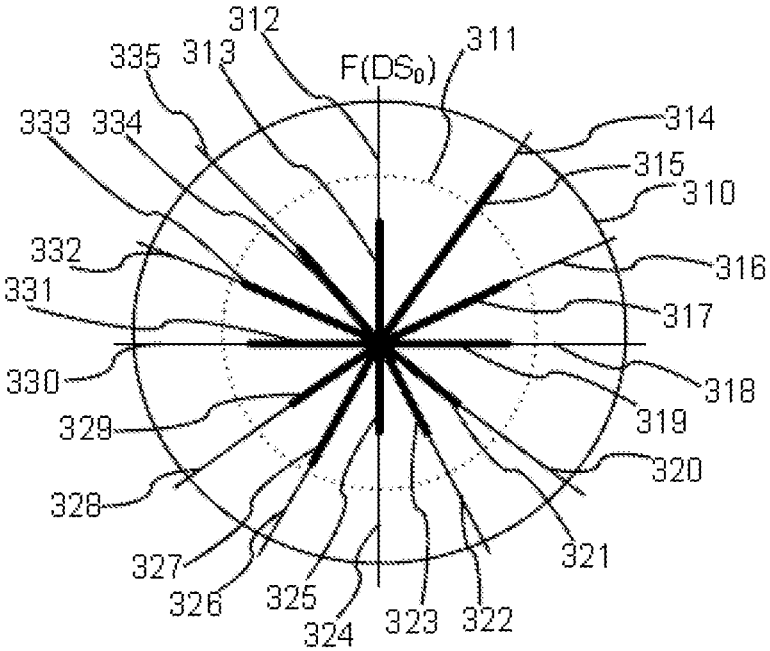
FIG. 6 shows a presentation of detections made by a monitoring system or method according to a preferable embodiment of the invention.

FIGS. 2 and 6 show a screen of the monitoring system of the crusher on which the loads detected by the monitoring system and corresponding to each rotational position of the main shaft 203 are presented to the operator, which rotational positions are determined with the pulses received from the detectors 211,213 of the main shaft in the manner described hereinbefore.

The rotational positions 112,114 of the main shaft 203 and the loads 113,115 of the crusher corresponding to these rotational positions are presented in a kind of a polar coordinate system on the screen of FIG. 2. The loads 113,115 corresponding to each rotational position are presented as vectors starting from the center of the polar coordinate system, the length of the vector illustrating the level of the load. The load may be presented in a corresponding coordinate system also in another way, for example as a dot or as dots which are connected circularly to each other.

In each rotational position, the presented load may be either the latest momentary value or an average value of detected loads of the rotational position in question which loads are measured from several revolutions of the main shaft 203. On the screen may be presented, for example, also the highest and lowest level of the loads, or for example simultaneously both the average and the momentary value or all previously mentioned at the same time.

A maximum load limit 110 of the crusher and a limit 111 depicting a desired load or the like of the crusher are presented also on the screen.

The load 115 detected in the rotational position 114 is clearly higher than the loads detected in the other rotational locations in the situation of the screen of FIG. 2. This may refer for example to the feed of the crusher not being even or to there being in the rotational position 114 uncrushable or very hard material in the crushing chamber 225 that might cause damaging of the blades 201,202 of the crusher. In the situation of the screen of FIG. 2, the feed of material into the crusher could be adjusted by the adjusting system 710 so that the load 115 in the rotational position would be decreased. When the load 115 has been steadied, the flow area of the feed opening 730 of the crusher could be increased with the adjusting system 710 so that the detected loads of all rotational positions would raise closer to the limit 110 of the maximum load.

The detected higher load may be caused by uncrushable material ending up in the crushing chamber. The detected higher load during several measuring revolutions on a certain sector corresponding to a rotational position of the inner blade enables reacting to the ending up of uncrushable material into the crushing chamber already before a load peak overriding safety limits would cause measures. Preferably the reaction can be initiated already from the first load peak which can be measured from both the power and the pressure.

FIG. 5 shows the screen of the monitoring system 214 so that the loads 313,315,317,319,321,323,325,327,329,331, 333,334 corresponding to each rotational position 312,314, 316,318,320,322,324,326,328,330,332,335 of the main shaft 203 are presented. The load situation of the crusher in FIG. 5 corresponds to the situation shown before in FIG. 2. A maximum load limit 310 of the crusher and a limit 311 depicting a desired load or the like of the crusher are presented also on the screen.

The load of the crusher is monitored with the monitoring system 214 in the rotational positions of the main shaft 203. Information on the load of the crusher from the monitoring system 214 is used to adjust the crushing event. The adjustment may take place with actions of the operator or automatically with suitable adjustment solutions. An object of the adjustment of the crushing event is among others an even loading in all rotational positions of the main shaft 203, a sufficiently high load for ensuring an efficient crushing event and detecting of uncrushable or very hard material before damaging of the crusher.

The foregoing description provides non-limiting examples of some embodiments of the invention. It is clear to a person skilled in the art that the invention is not restricted to details presented, but that the invention can be implemented in other equivalent means. Some of the features of the above-disclosed embodiments may be used to advantage without the use of other features.

As such, the foregoing description shall be considered as merely illustrative of the principles of the invention, and not in limitation thereof. Hence, the scope of the invention is only restricted by the appended patent claims.

The invention claimed is:

1. A method for monitoring a gyratory or cone crusher, comprising:

rotating a main shaft of the crusher and an inner blade arranged on the main shaft for creating repeating measuring revolutions;

determining a starting point of a measuring revolution during rotation of the main shaft upon receipt of a triggering pulse from the main shaft of the crusher during rotation of the main shaft;

receiving a plurality of measuring pulses from a drive shaft of the crusher after receipt of the triggering pulse and during the measuring revolution;

determining at least one rotational position of the inner blade of the crusher based upon receipt of one of the measuring pulses from the drive shaft of the crusher; and measuring a load of the crusher at the moment of receipt of every measuring pulse from the drive shaft.

2. The method of claim 1, wherein the load of the crusher is determined by a pressure measurement.

3. The method of claim 1, wherein the load of the crusher is determined by a power measurement.

4. The method of claim 1, wherein an average of the load of the crusher corresponding to every determined rotational position of the inner blade of the crusher is determined from a period of several measuring revolutions.

5. The method of claim 1, wherein the triggering pulse from the main shaft of the crusher is implemented by a magnetic detector.

6. The method of claim 1, wherein the measuring pulse from the drive shaft of the crusher is implemented by a magnetic detector.

7. The method of claim 1, wherein the load of the crusher corresponding to each rotational position of the inner blade is presented on a screen to be observed by an operator.

8. The method for monitoring a gyratory or cone crusher of claim 1, which gyratory or cone crusher comprises a crushing chamber and a feed opening of the crushing chamber, wherein a flow area of material to be crushed and flowing through the feed opening to the crushing chamber is adjusted during crushing by decreasing the flow area as a response to detecting an increase of an average load, and increasing the flow area as a response to detecting a decrease of the average load.

9. The method of claim 8, further comprising the step of adjusting the feed of the material during crushing so that the amount of the material is increased at a rotational position of the inner blade which corresponds to a low load.

10. A system for monitoring a gyratory or cone crusher wherein the system comprises:

an first element placed on a main shaft of the crusher and rotatable with the main shaft during repeating revolutions of the main shaft;

a first detector operable for detecting rotational movement of the first element past the first detector, wherein the first detector is configured to provide a triggering pulse that determines a starting point of a measurement revolution upon rotation of the first element past the first detector;

at least one second element placed on a drive shaft of the crusher;

a second detector operable for detecting the rotational movement of the second element past the second detector during the measurement revolution, wherein the second detector is configured to provide a plurality of measuring pulses during the measurement revolution, wherein each measuring pulse corresponds to a rotational position of an inner blade of the crusher; and a sensor operable to measure a load of the crusher upon receipt of each of the plurality of measuring pulses during the measurement revolution.

11. The system of claim 10, wherein the system comprises an output to a screen for presenting a load measured at the moment of receipt of one of the measuring pulses corresponding to each rotational position of the inner blade of the crusher.

12. The system of claim 11, wherein the rotational positions of the inner blade of the crusher and the loads corresponding to said rotational positions or the averages of the loads are presented on a polar coordinate system.

13. The system of claim 10, wherein the system comprises a screen on which is presented an average of the load, calculated from a period of several measuring revolutions, corresponding to the rotational positions of the inner blade of the crusher, and the rotational positions.

14. The system of claim 13, wherein the second detector suitable for detecting the second elements to be placed on the drive shaft is a magnetic detector.

15. The system of claim 10, wherein the rotational position of the inner blade of the crusher is presented as a rotation angle.

16. The system of claim 10, wherein the sensor operable to measure the load is measuring pressure.

17. The system of claim 10, wherein the sensor operable to measure the load is measuring power.

18. The system of claim 10, wherein the first detector suitable for detecting the first element to be placed on the main shaft is a magnetic detector.

19. The system of claim 10, wherein the gyratory or cone crusher comprises a crushing chamber and a feed opening of the crushing chamber, and an adjusting apparatus, wherein one or more movable adjusting parts comprised by the adjusting apparatus are arranged in connection with the feed opening, wherein the adjusting apparatus is configured to adjust during crushing a flow area of material to be crushed and flowing through the feed opening to the crushing chamber by moving adjustment parts such that the flow area is decreased as a response to an average load detected by the monitoring system increasing, and the flow area is increased as a response to the average load detected by the monitoring system decreasing.

20. The system of claim 19, wherein the feed of the material during crushing is adjusted so that amount of the material is increased at a rotational position of the inner blade which corresponds to a low load.

21. A method for adjusting a gyratory or cone crusher or a crushing plant which gyratory or cone crusher or crushing plant comprises a crushing chamber and a feed opening of the crushing chamber, wherein the gyratory or cone crusher or crushing plant comprises a system for monitoring the crusher according to claim 10, and in the method a flow area of material to be crushed and flowing through the feed opening to the crushing chamber is adjusted so that the flow area is decreased as a response to the load detected by the monitoring system increasing, and the flow area is increased as a response to the load detected by the monitoring system decreasing.

22. The method of claim 21, wherein the gyratory or cone crusher comprises a crusher drive and a feedback control system which comprises the monitoring system, wherein the adjusting is based on the detected load.

23. The method of claim 21, wherein feed of the material is adjusted during crushing such that amount of the material is increased at a rotational position of the inner blade which is corresponding to a low load.

24. A gyratory or cone crusher, comprising:

a crushing chamber;

a feed opening to the crushing chamber;

an adjusting apparatus including one or more movable adjusting parts to be arranged in connection with the feed opening which one or more movable adjusting parts are movable during crushing to adjust a flow area of material to be crushed and flowing through the feed opening to the crushing chamber;

a first element placed on a main shaft of the crusher and rotatable with the main shaft during repeating revolutions of the main shaft;

a first detector operable for detecting rotational movement of the first element past the first detector, wherein the first detector is configured to provide a triggering pulse that determines a starting point of a measurement revolution upon rotation of the first element past the first detector with rotation of the main shaft;

at least one second element placed on a drive shaft of the crusher;

a second detector operable for detecting the rotational movement of the second element past the second detector during the measurement revolution, wherein the second detector is configured to provide a plurality of measuring pulses during the measurement revolution, wherein each measuring pulse corresponds to a rotational position of an inner blade of the crusher; and a sensor operable to measure a load of the crusher upon receipt of each measurement pulse during the measurement revolution, wherein the one or more adjusting parts are configured to move such that the flow area is decreased as a response to a load detected increasing and the flow area is increased as a response to a load detected decreasing.

25. The gyratory or cone crusher of claim 24, wherein the adjusting apparatus is configured to adjust the feed of the material during crushing so that amount of the material is increased at a rotational position of the inner blade which corresponds to a low load and is detected by the monitoring system.

26. A crushing plant, wherein the crushing plant comprises a gyratory or cone crusher of claim 24.

* * * * *